United States Patent [19]

Childs

[11] Patent Number: 4,699,317

[45] Date of Patent: Oct. 13, 1987

[54] HEAT EXCHANGER FLUE

[75] Inventor: Henry T. Childs, Chattanooga, Tenn.

[73] Assignee: Temperature Adjusters, Inc., Chattanooga, Tenn.

[21] Appl. No.: 827,383

[22] Filed: Feb. 7, 1986

Related U.S. Application Data

[62] Continuation-in-part of Ser. No. 601,655, Apr. 18, 1984, Pat. No. 4,702,179.

[51] Int. Cl.[4] ..... F24H 3/02

[52] U.S. Cl. ..... 237/81; 237/55; 126/110 R; 110/215

[58] Field of Search ..... 237/55, 53, 50, 51, 237/81; 126/110 R, 99 R, 99 A; 122/20 B; 110/215

[56] References Cited

U.S. PATENT DOCUMENTS

| | | | |
|---|---|---|---|
| 1,417,987 | 5/1922 | Griffith | 237/54 |
| 2,355,495 | 8/1944 | Zier | 237/55 |
| 4,389,980 | 6/1983 | Marcotte et al. | 122/20 B X |
| 4,512,288 | 4/1985 | Michaud | 122/20 B |

*Primary Examiner*—Henry A. Bennet

[57] ABSTRACT

This invention relates to a method and apparatus for the extraction of the heat from the flue exhaust of a fuel burn in a furnace, stove or fireplace. The Heat Exchanger Flue can be adjusted vertically and horizontally in length to obtain a high efficiency in the extraction of the heat from said flue exhaust. The design is for the flue to have self cleaning features of soot and fly ash with storage and clean out areas, thus working well when coal is used for fuel. The heat can be extracted from said flue exhaust by air circulation or by water circulation. The design is flexable in the arrangements of the flue, thus allowing installation indoors or outdoors, or the combination of both.

6 Claims, 18 Drawing Figures

HEAT EXCHANGER FLUE

RELATED U.S. APPLICATION DATA

Continuation-in-part of Ser. No. 06/601,655 filed Apr. 18, 1984 now U.S. Pat. No. 4,702,179.

BACKGROUND OF THE INVENTION

The efficiency of capturing the heat produced by the fuel burn in a number of furnaces, stoves and expecially fireplaces is low, as a large percentage of said heat is lost to the outdoors through the flue or chimney. Various designs have been made to capture more of this lost heat, yet there are still many heating systems that loose much of its heat to the outdoors. A fireplace is especially wasteful of our fuel, as it has a high percentage of heat loss.

The flue or chimney is the passageway for the fuel burn of a furnace, stove or fireplace to exhaust outdoors and is also a passageway for this lost heat to escape outdoors.

However, in this invention, the design of this flue can transport fuel burn exhaust to the outdoors, as it should, but as it does, its heat can be extracted, thereby increasing the efficiency of a furnace, stove and especially a fireplace greatly and reducing this extra expense of fuel waste.

SUMMARY OF THE INVENTION

The purpose of this invention is to provide a way to extract the wasted heat from the fuel burn exhaust of a furnace, stove or fireplace, that is being lost through the flue to the outdoors.

The designed flue has self-cleaning features with soot and fly ash storage and clean out areas, so it can be conveniently used with the burn of most any fuel, even coal. The design also allows the flue to be used as a water heating system and by using hot water sponge tanks allows a number of ways to distribute heat and to cool with the use of chillers. The flexable arrangement of the flue allows its location indoors or outdoors or the combination of both.

Various other features of the method and apparatus of the present invention will become obvious to those skilled in the act upon reading the disclosure set forth hereinafter.

BRIEF DESCRIPTION OF DRAWINGS

Referring now to the drawings which show the flue apparatus and its functions that transport fuel burn exhaust from a furnace, stove or fireplace to the outdoors, with its ability to extract heat from said exhaust, and to self clean, collect and store soot and fly ash.

DETAILED DESCRIPTION

Figure 1:
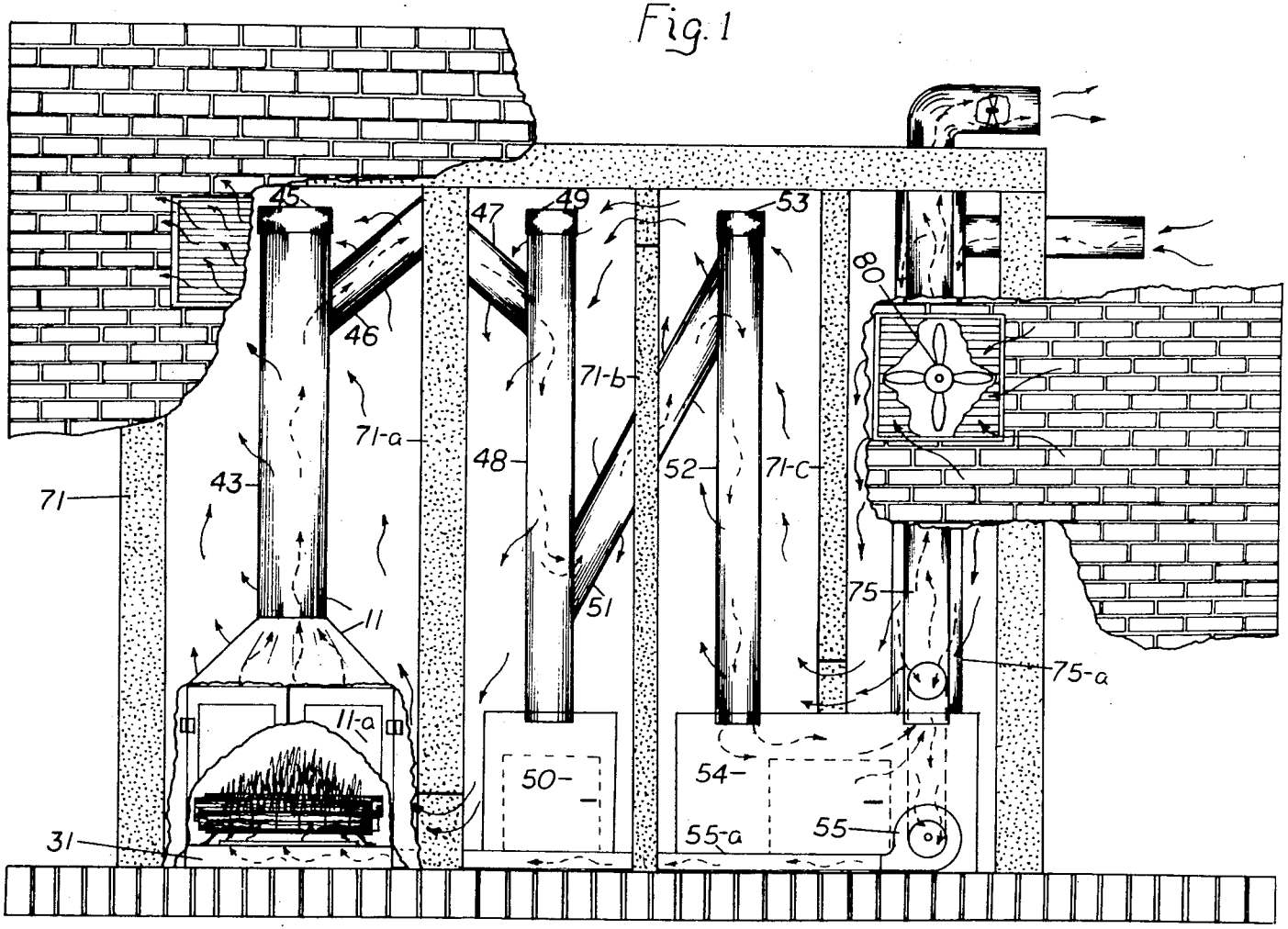
FIG. 1, is a cut-a-way view of the apparatus connecting a fireplace exhaust to the outdoors and showing its vertical and semi-vertical exhaust air pipes, the ash storage boxes, the enclosed compartment of each vertical exhaust air pipe, and the fan that circulates indoor air through the compartments, thus transferring heat indoors. The fireplace is enclosed and a forced draft fan delivers heated outdoor air to the fire.

Referring to FIG. 1, there is illustrated a cut-a-way layout of the apparatus connected to the exhaust of a fireplace and serving as a flue to the outdoors. The fireplace 11 is enclosed with doors 11-*a* and rest on an air tight box 31. An adjustable forced draft air vent is located in the floor of the fireplace, serving as a passageway for forced draft air from the air tight box 31 to enter the fireplace and feed the fire.

The top exhaust of the fireplace 11 is connected to the lower end of vertical exhaust air pipe 43, which has its upper end capped with cap 45. Vertical pipe 48 is positioned next to vertical pipe 43 with its upper end capped with cap 49, and its lower end inserted into the top of air tight box 50, having a side servicing door. Vertical pipe 48 has its top side connected to the top side of vertical pipe 43, with semi-vertical exhaust air pipes 46 and 47. Vertical exhaust air pipe 52 is positioned next to vertical pipe 48, away from the fireplace 11, with its top capped with cap 53, and with its bottom end inserted into the top of air tight box 54, having a side servicing door. The top side of vertical pipe 52 is connected to the bottom side of vertical pipe 48 with semi-vertical exhaust air pipe 51. Vertical exhaust air pipe 75 is positioned next to vertical pipe 52, with its lower end inserted into the top of air tight box 54, which also contains the lower end of vertical pipe 52. Said pipe 75 extends vertically until its upper end extends through and beyond any height or width of the structure that encloses the apparatus, to the outdoor air, thus allowing the fireplace exhaust to pass through said apparatus and exit outdoors. A fan is located near the top of vertical pipe 75 for induced draft, when needed. Vertical pipe 75-*a*, being larger in diameter than vertical pipe 75, is positioned so that pipe 75 extends through the inside of larger pipe 75-*a*, with the upper end of the larger pipe 75-*a* extending beyond the height or width of the structure that encloses the apparatus, to the outdoor air, and its lower end is connected to a forced draft fan 55, located near its base, providing means for outdoor intake air to be drawn into the top of larger pipe 75-*a*, through and down between its inside walls and the outer walls of the inner pipe 75, into the draft fan, thus extracting any heat that the fuel burn exhaust might have as it passes through inner pipe 75 to the outdoors. Said draft fan 55 has its output ducted through air pipe 55-*a* into the air tight box 31, beneath the fireplace and supplies the outdoor heated air to the fireplace.

The insulated weatherproof structure 71 encloses the apparatus into one unit and there are insulated partitions positioned between the vertical exhaust air pipes forming the vertical exhaust air pipe compartments. An air circulating fan 80 is located to deliver its output of indoor air into the vertical exhaust air pipe compartment most remote from the fire. An air vent is located at the bottom of the partition 71-*c* that allows said indoor air to pass from the compartment most remote from the fire into the adjacent compartment containing vertical exhaust air pipe 52. An air vent is located at the top of the partition 71-*b* that allows said indoor air to pass on into the adjacent compartment containing vertical exhaust air pipe 48. An air vent is located at the bottom of the partition 71-*a* that allows said indoor air to pass on into the adjacent compartment containing vertical exhaust air pipe 43 and the fireplace, and an air vent is located at the top of said compartment that allows the indoor air to pass on back indoors, thus as the indoor air circulates through the apparatus, it gathers the heat given off be the fireplace exhaust and creates a high efficiency fireplace.

Figure 2:
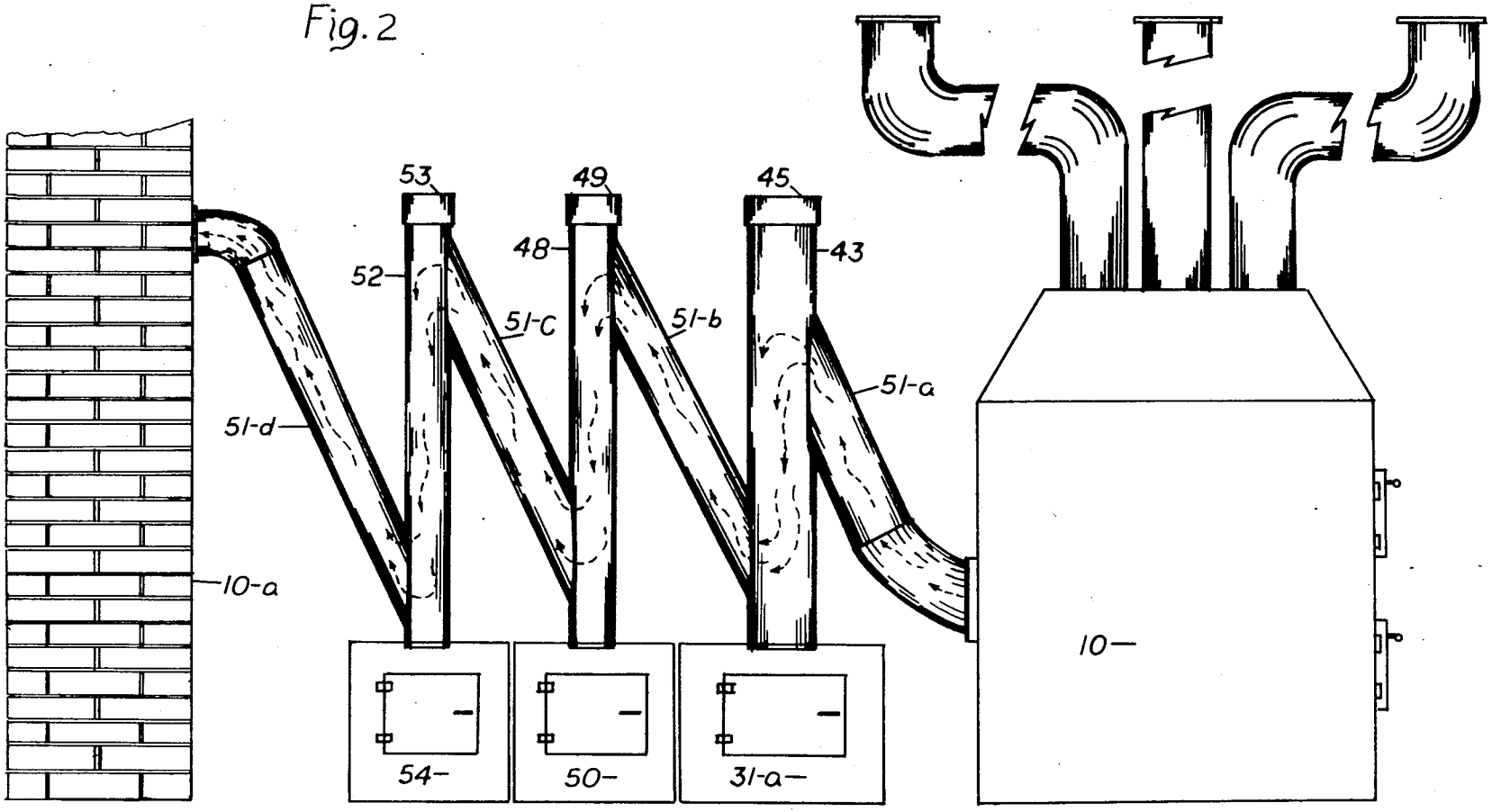
FIG. 2, is a view of the apparatus and its flue arrangement of vertical and semi-vertical exhaust air pipes with their ash storage boxes connecting a furnace exhaust to an outdoor chimney.

Referring now to FIG. 2, there is illustrated a furnace 10, having forced draft, and the outdoor chimney 10-*a*, with the apparatus serving as a flue connecting the exhaust of said furnace 10 to the chimney 10-*a*. As the exhaust opening is located on the side of the furnace 10, vertical pipe 43 is positioned next to said exhaust opening, and has its top side connected to said furnace exhaust opening with semi-vertical pipe 51-*a*. Pipe 43 has its upper end capped with cap 45 and its lower end inserted into the top of air tight box 31-*a*, which has a side servicing door. Vertical pipe 48 is positioned next to vertical pipe 43, away from the furnace 10, with its upper end capped with cap 49, and its lower end inserted into the top of air tight box 50, having a side servicing door. Vertical pipe 48 has its top side connected to the bottom side of vertical pipe 43, with semi-vertical exhaust air pipe 51-*b*. Vertical exhaust air pipe 52 is positioned next to vertical pipe 48, away from the furnace 10, with its top capped with cap 53, and with its bottom end inserted into the top of air tight box 54, having a side servicing door. The top side of vertical pipe 52 is connected to the bottom side of vertical pipe 48 with semi-vertical exhaust air pipe 51-*c*. Semi-vertical exhaust air pipe 51-*d* connects the bottom side of vertical pipe 52, being the most remote from the furnace 10, to the outdoor chimney 10-*a*, thus completing the apparatus and allowing the fuel burn exhaust to exit the furnace 10 into semi-vertical pipe 51-*a*, pass into the top side of vertical pipe 43, continue down through pipe 43 into semi-vertical pipe 51-*b*, with soot and fly ash falling into box 31-*a* below, said exhaust rising up through pipe 51-*b* into the top side of vertical pipe 48, down through pipe 48 into the semi-vertical pipe 51-*c*, with soot and fly ash falling into box 50 below, said exhaust rising up through pipe 51-*c* into the top side of vertical pipe 52, down through pipe 52 into the semivertical pipe 51-*d*, with any soot and fly ash falling into box 54 below, said exhaust rising up through pipe 51-*d* into the chimney and to the outdoors.

Figure 3:
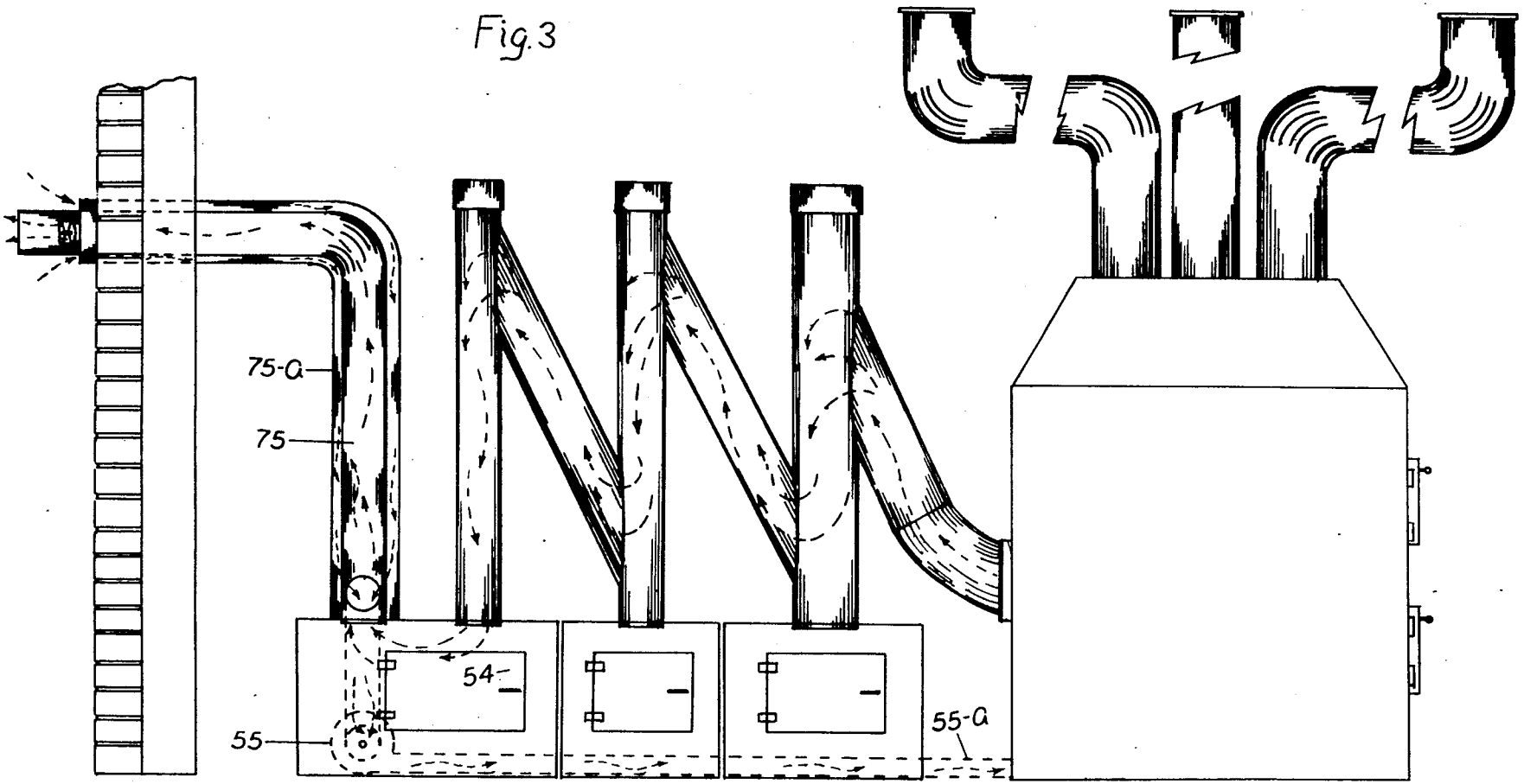
FIG. 3, is a view of the apparatus and its flue arrangement of vertical and semi-vertical exhaust air pipes, with their ash storage boxes, connecting a furnace exhaust to an outdoor chimney and shows a forced draft fan with means of delivering outdoor air, heated by the exhaust, into the furnace.

FIG. 3, illustrates the apparatus connected to a furnace, as shown in FIG. 2, however box 54 is enlarged and semi-vertical exhaust pipe 51-*d* is replaced by vertical exhaust air pipe 75, which is the exhaust pipe that carries the furnace burn exhaust from box 54 to the outdoors, with pipe 75 being inserted through the larger pipe 75-*a*, which serves as an outdoor air intake pipe, heats and transports said intake heated air into the forced draft fan 55, which feeds said air through pipe 55-*a* into the furnace fire.

Figure 4:
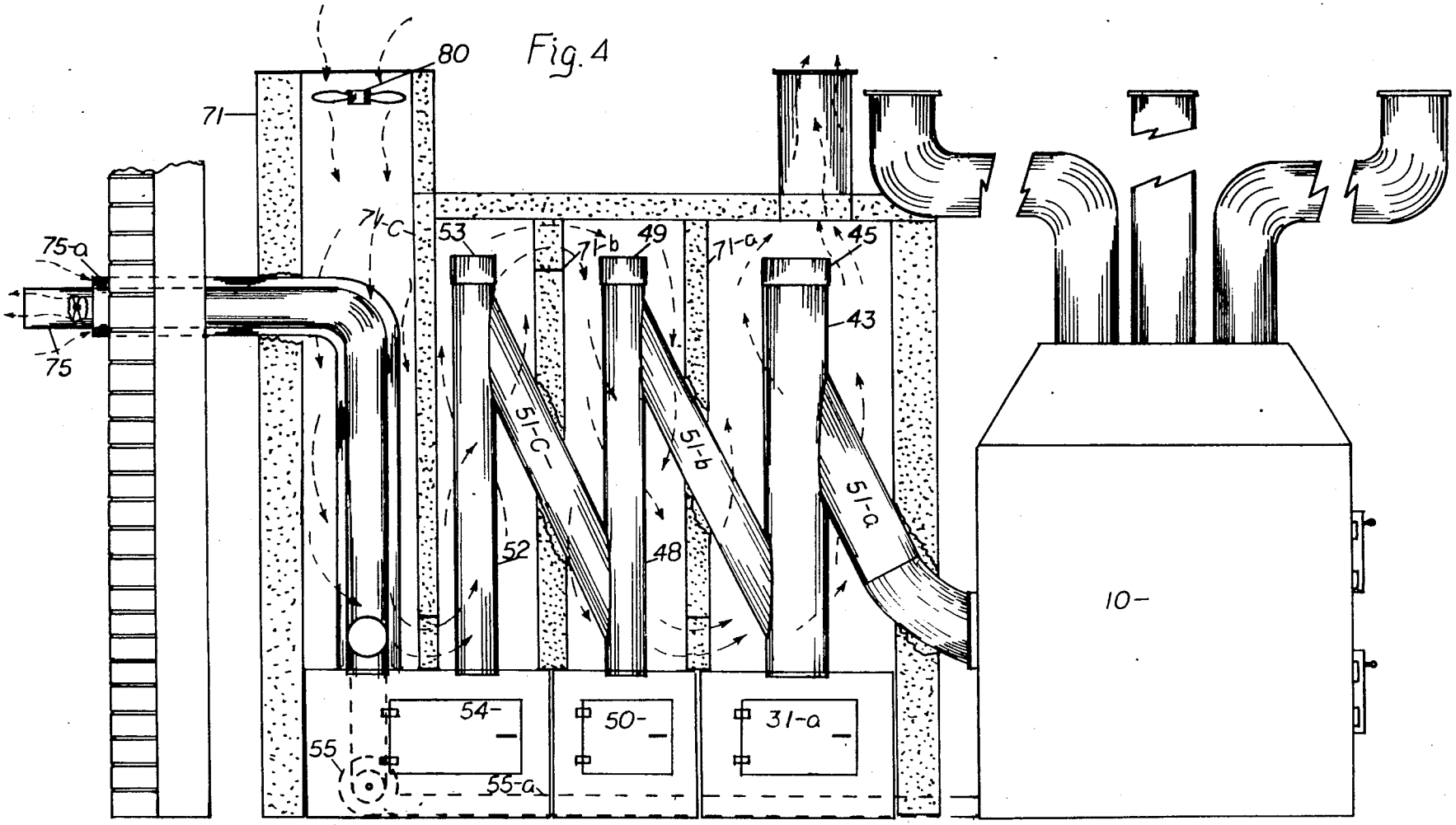
FIG. 4, is a cut-a-way view of the apparatus connecting a furnace exhaust to the outdoors and showing its vertical and semi-vertical exhaust air pipes, the ash storage boxes, the enclosed compartment of each vertical exhaust air pipe, and the fan that circulates indoor air through the compartments to transfer heat indoors. A forced draft fan is shown to deliver heated outdoor intake air to the furnace.

FIG. 4, illustrates the apparatus connected to a furnace, as shown in FIG. 3, however the vertical and semi-vertical exhaust air pipes of the apparatus are enclosed with an insulated structure, described in FIG. 1, with insulated partitions located between the vertical exhaust air pipes, forming the vertical exhaust air pipe compartments. The air circulating fan 80 is located to deliver its output of indoor air through the series of compartments, as explained in FIG. A-1, with said air being returned back indoors through a vent, thus conveying with it the heat the apparatus extracts from the furnace fuel burn exhaust, as it travels through said apparatus and outdoors.

Figure 5:
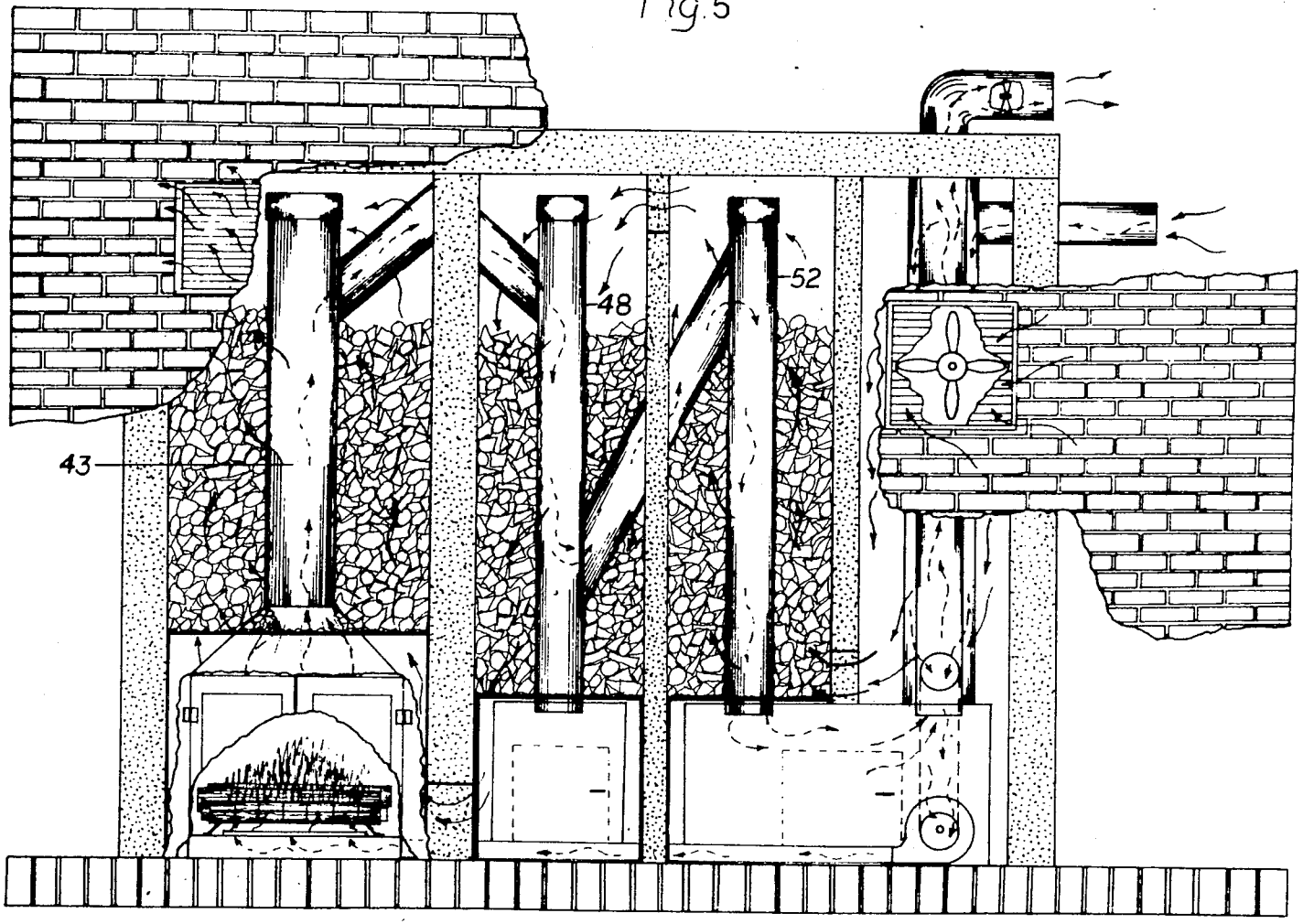
FIG. 5, is a cut-a-way view of a fireplace and the apparatus of vertical exhaust air pipe compartments containing rock or gravel, with the indoor air circulated through the gravel to extract the heat given off by the vertical and semi-vertical exhaust air pipes and absorbed by the gravel, thus accelerating its efficiency.

FIG. 5, illustrates the apparatus connected to the exhaust of a fireplace, as described previously, but vertical exhaust air pipe 43 has a frame structure covered with hardware cloth, constructed horizontally across its compartment near its base with said compartment containing a volume of gravel or rock. Vertical exhaust air pipe 48 has a frame structure, covered with hardware cloth, constructed horizontally across its compartment near its base with said compartment containing a volume of gravel or rock. Vertical exhaust air pipe 52 has a frame structure, covered with hardware cloth, constructed horizontally across its compartment near its base with said compartment containing a volume of gravel or rock. The gravel or rock serves as a reservoir for the heat given off by the vertical and semi-vertical exhaust air pipes and increases the efficiency of the apparatus and the fireplace.

Figure 6:
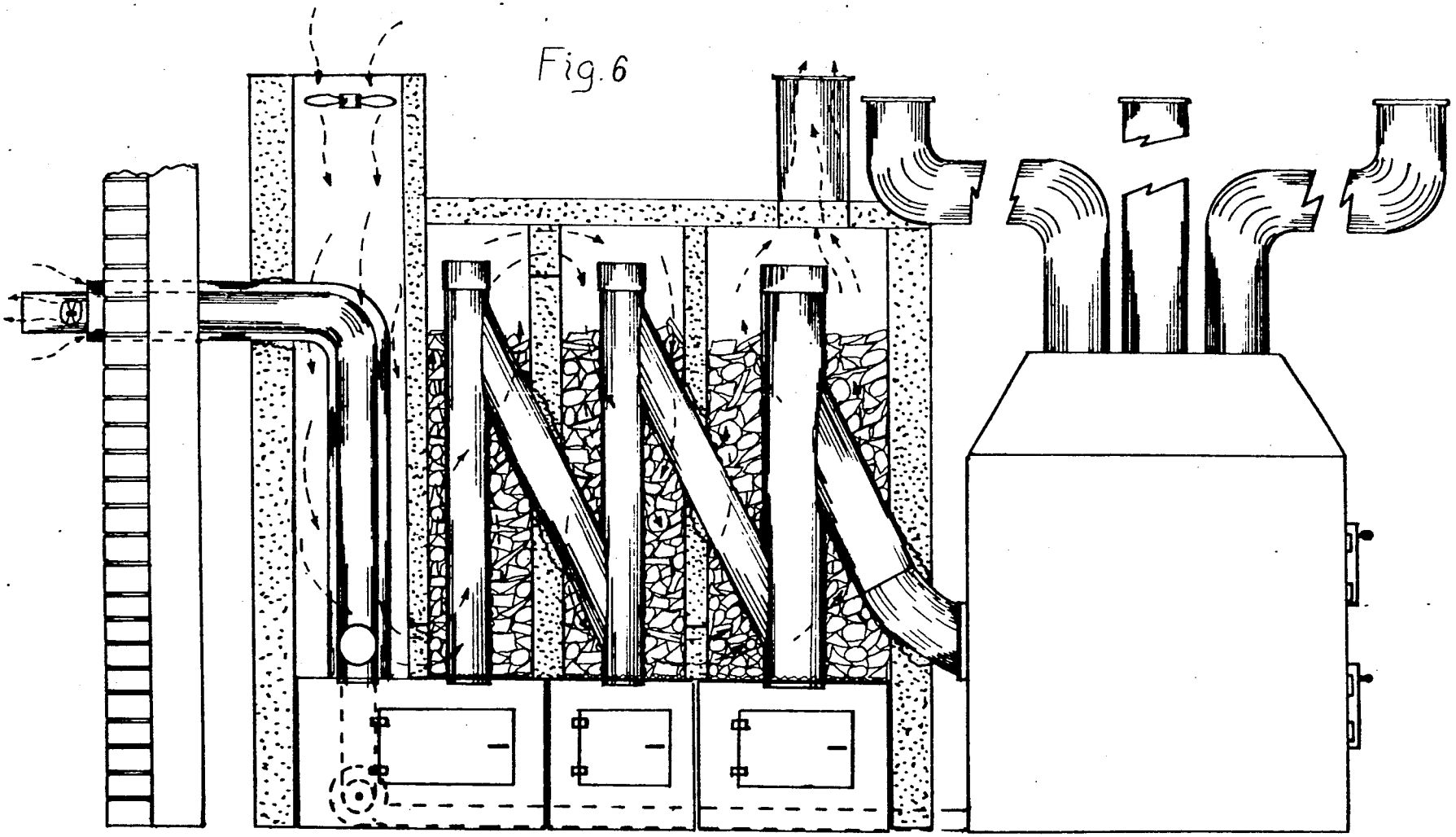
FIG. 6, is a cut-a-way view of a furnace and the apparatus of vertical exhaust air pipe compartments containing rock or gravel, with the indoor air circulated through the gravel to extract the heat given off by the vertical and semi-vertical exhaust air pipes and absorbed by the gravel, thus accelerating its efficiency.

FIG. 6, illustrates the addition of gravel or rock to the apparatus that is attached to a furnace exhaust, as previously described, thus increasing the efficiency of the apparatus and the furnace.

Figure 7:
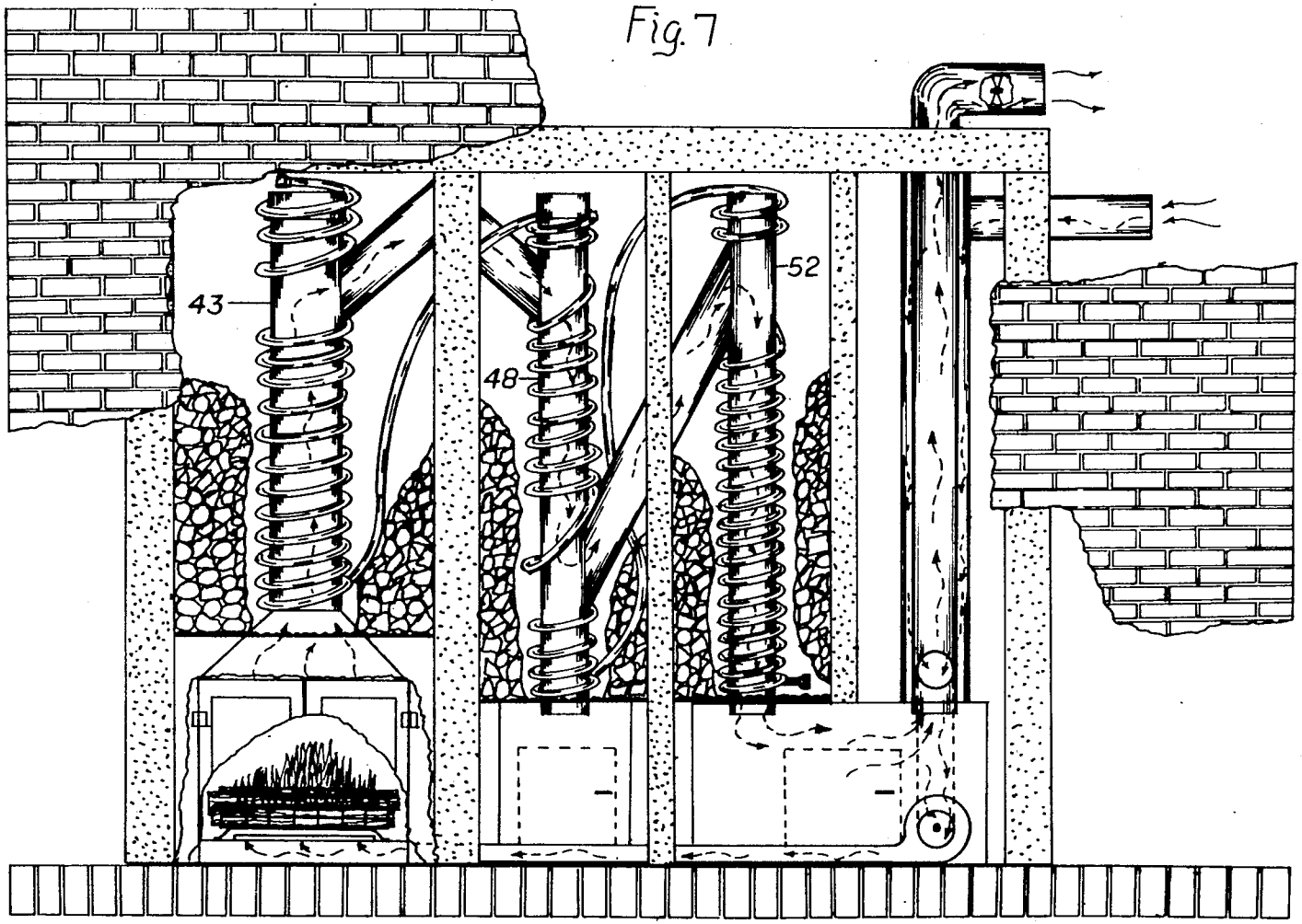
FIG. 7, is a cut-a-way view of a fireplace and apparatus of vertical exhaust air pipe compartments, showing water heat pipes coiled around the vertical exhaust air pipes, connected in series and covered with gravel, thus using the apparatus to heat water circulated through the coiled heat pipes to be stored in a water tank and using the gravel to increase its efficiency.

FIG. 7, illustrates the apparatus connected to the exhaust of a fireplace as described previously, but showing vertical exhaust air pipe 52 with water heat pipes coiled about it, and vertical exhaust air pipe 48 with water heat pipes coiled about it and vertical exhaust air pipe 43 with water heat pipes coiled about it, with said coils connected in series from the top of vertical pipe 52 to the base area of vertical pipe 48 and from the top of vertical pipe 48 to the base area of vertical pipe 43 and with connection means for water to circulate from a storage tank through said series of coils, from the base of vertical pipe 52, to the top of vertical pipe 43 and back into the water storage tank, thus removing heat given off by the vertical exhaust air pipes of the apparatus and storing same in the water storage tank. Each vertical exhaust air pipe compartment containing said water heat pipes having said coild covered with gravel, as the cut-a-way view shows, to increase the efficiency of capturing all of the heat produced by the apparatus.

Figure 8:
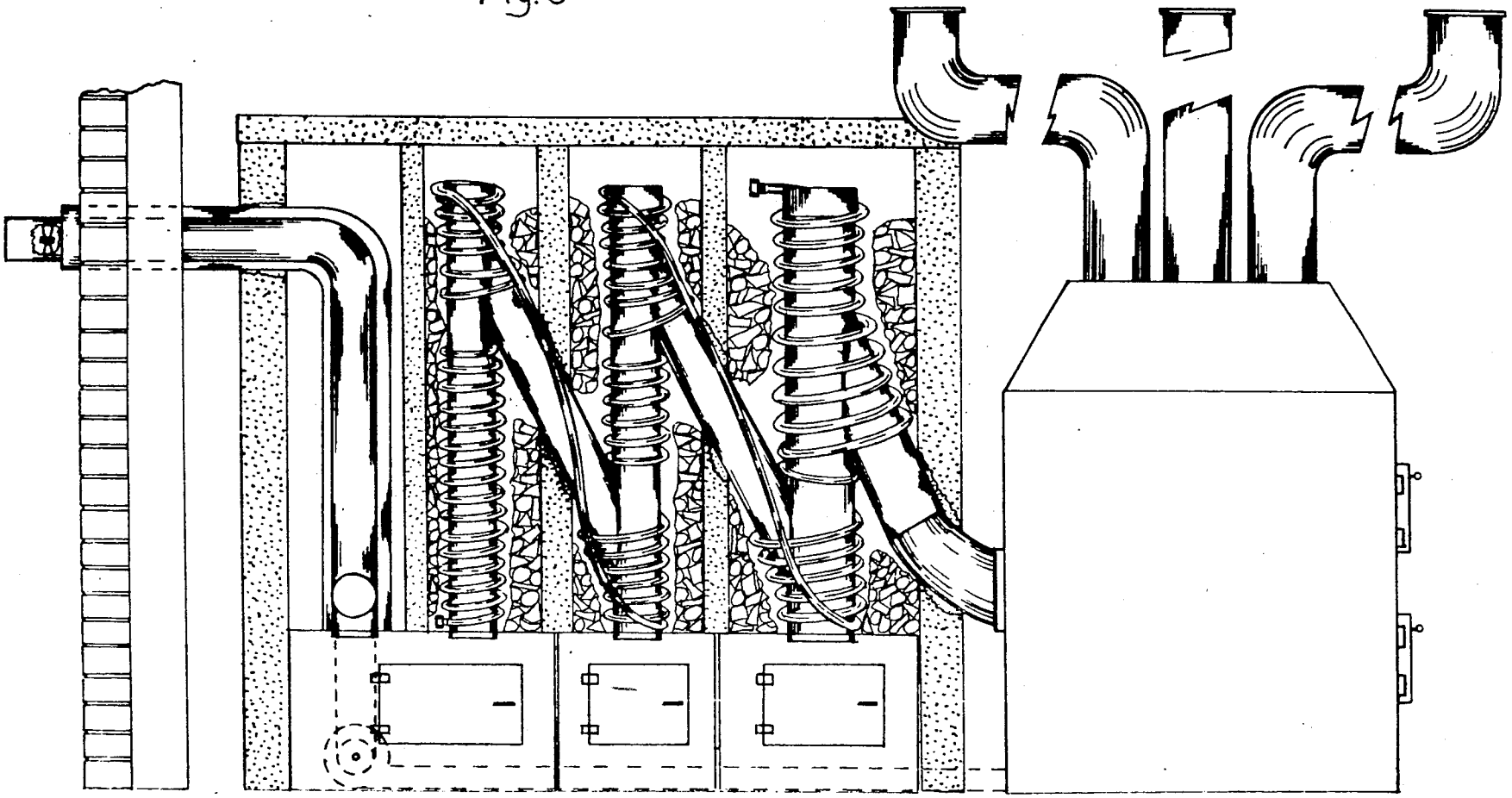
FIG. 8, is a cut-a-way view of a furnace and the apparatus of vertical exhaust air pipe compartments showing water heat pipes coiled around the vertical exhaust air pipes, connected in series and covered with gravel, thus using the apparatus to heat water circulated through the coiled heat pipes to be stored in a water storage tank and using the gravel to increase its efficiency.

FIG. 8, illustrates the apparatus connected to the exhaust of a furnace, as described proviously, and also showing the water heat pipe coils located about the vertical exhaust air pipes, as described above, with said water heat pipe coils covered with gravel.

Figure 9:
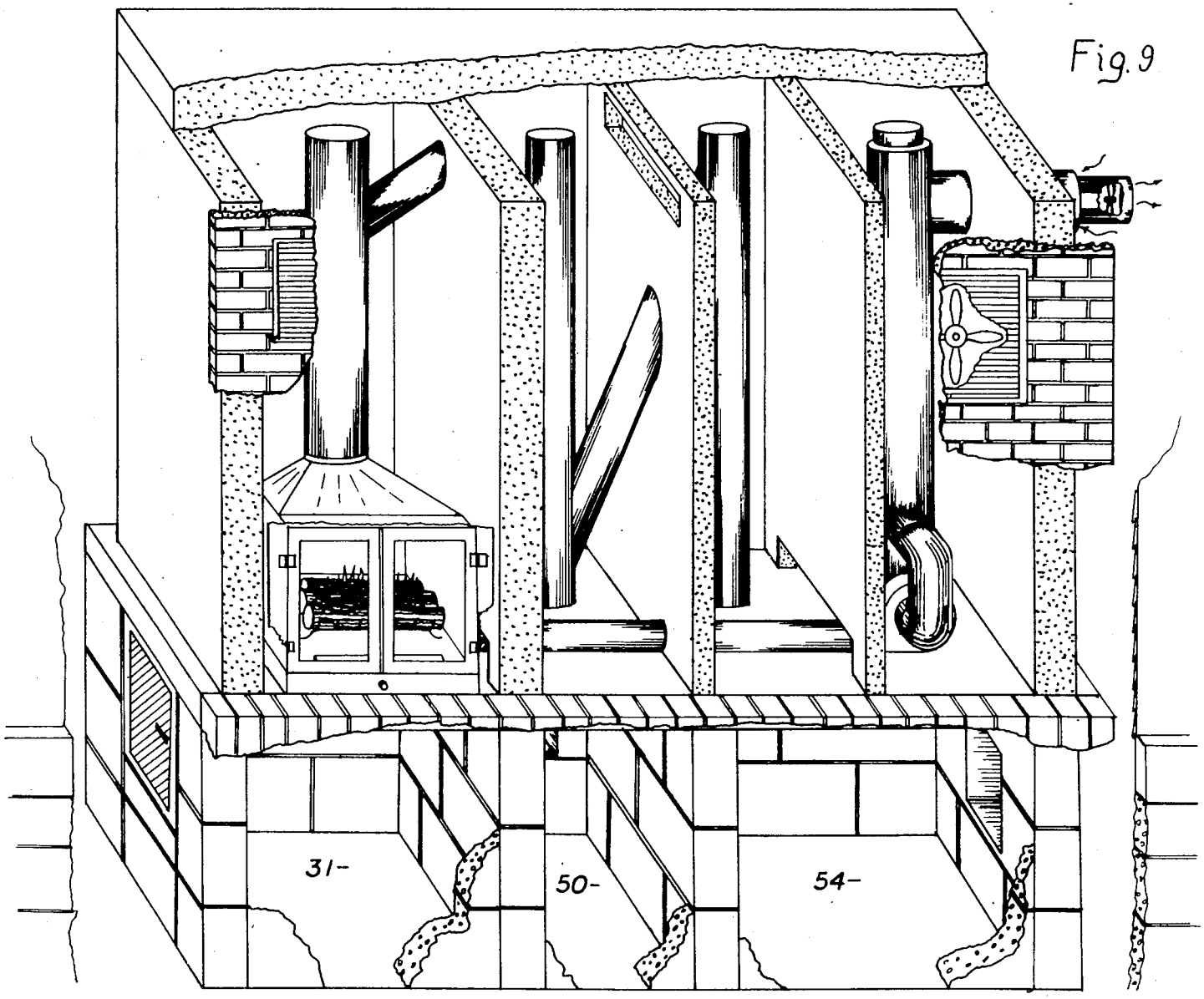
FIG. 9, is a cut-a-way view of a furnace and the apparatus of vertical exhaust air pipe compartments, showing the soot and fly ash storage areas built in the block foundation supporting the fireplace and the apparatus of flue pipes.

FIG. 9, illustrates a side view of the apparatus connected to the exhaust of a fireplace with the air tight soot and ash storage boxes 31, 50 and 54 built into the foundation of the apparatus and showing its location in the outer wall of a building.

Figure 10:
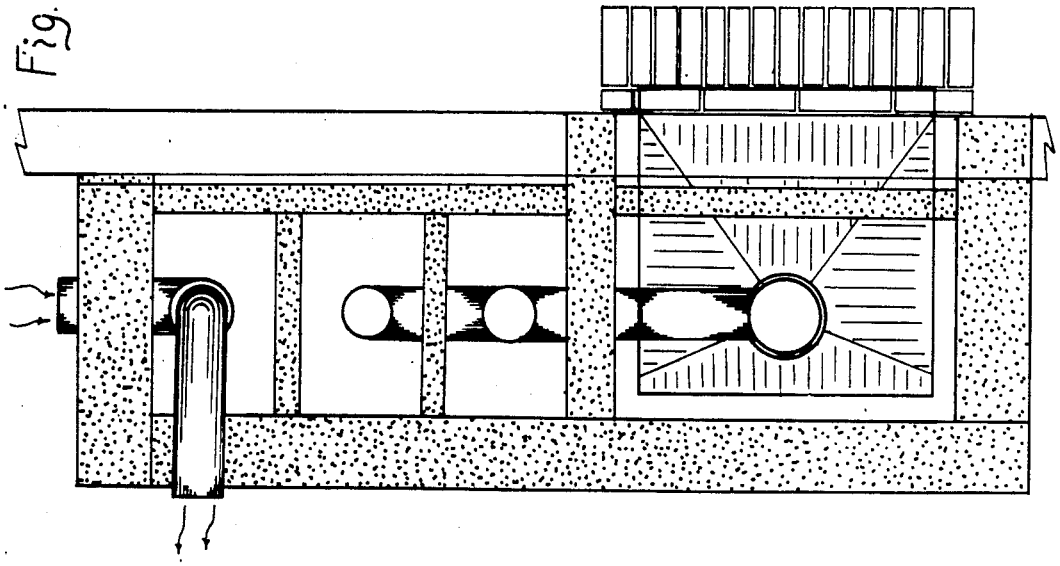
FIG. 10, is a cut-a-way top view of the apparatus and its vertical exhaust air pipe compartments connected to a fireplace and the location of the apparatus against an outdoor wall.

FIG. 10, illustrates a top view of the apparatus connected to the exhaust of a fireplace and its vertical exhaust air pipes and compartments and its location along the outer wall of a building.

Figure 11:
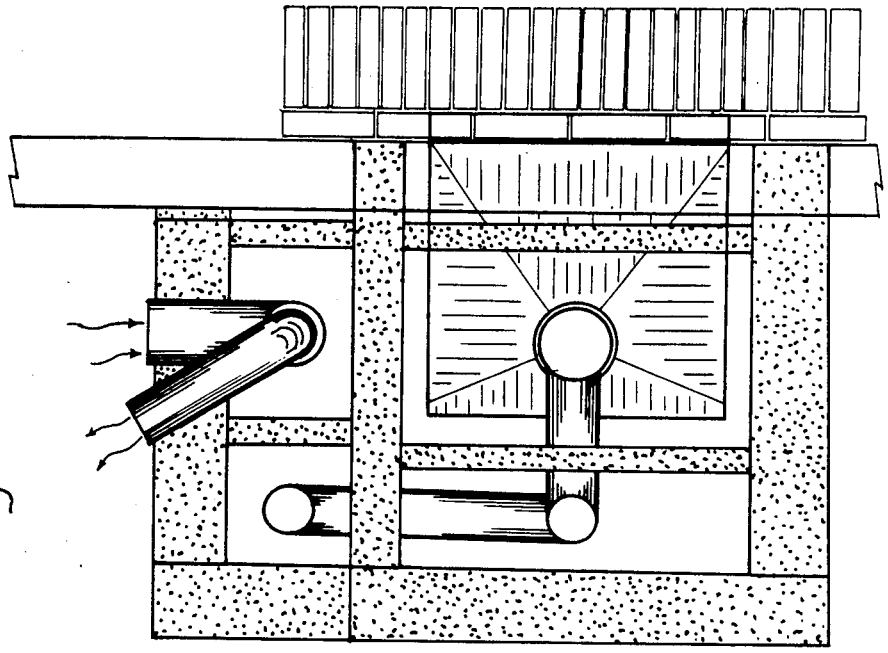
FIG. 11, is a cut-a-way top view of the apparatus and its vertical exhaust air pipe compartments arranged in different positions and connected to a fireplace and located against an outdoor wall.

FIG. 11, illustrates a top view of the apparatus connected to the exhaust of a fireplace and its vertical exhaust air pipes and compartments showing said vertical exhaust air pipes in a different arrangement, and their location to the outer wall of a building.

Figure 13:
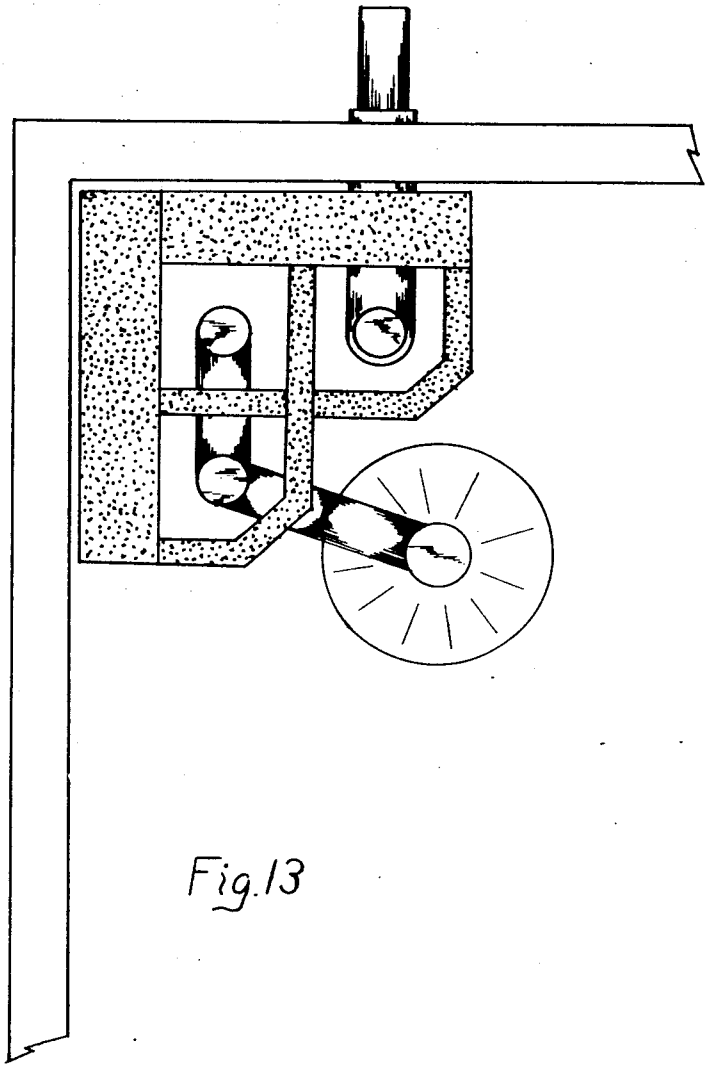
FIGS. 12, and 13, are two cut-a-way top views showing two different arrangements of the apparatus and its vertical exhaust air pipe compartments connected to the exhaust of enclosed free standing fireplaces or stoves, burning wood, coal, gas, oil, or any fuel, each located indoors and vented through a building wall to the outdoors, with an outdoor intake air vent.
Figure 12:
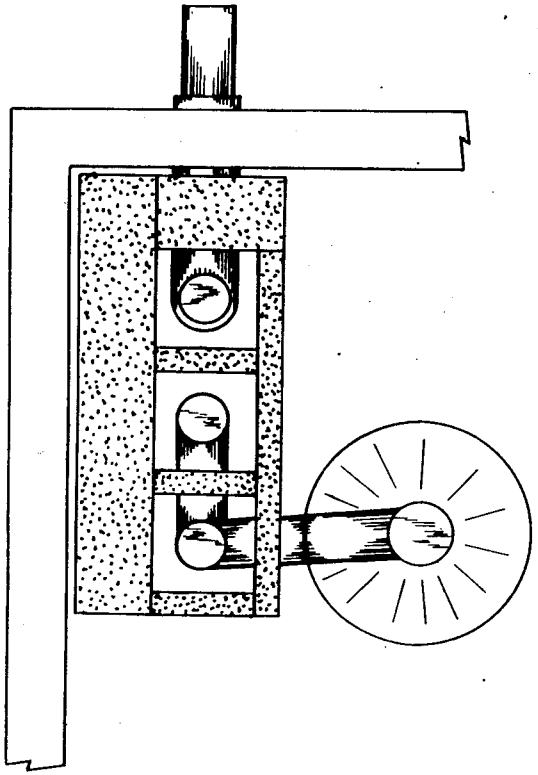

FIGS. 12, and 13, illustrate top views of the apparatus connected to the exhaust of an enclosed free standing fireplace or stove, burning wood, coal, gas, oil or any fuel, with the total apparatus located indoors showing different arrangements of the vertical exhaust air pipes and their connection to the outdoor air.

Figure 14:
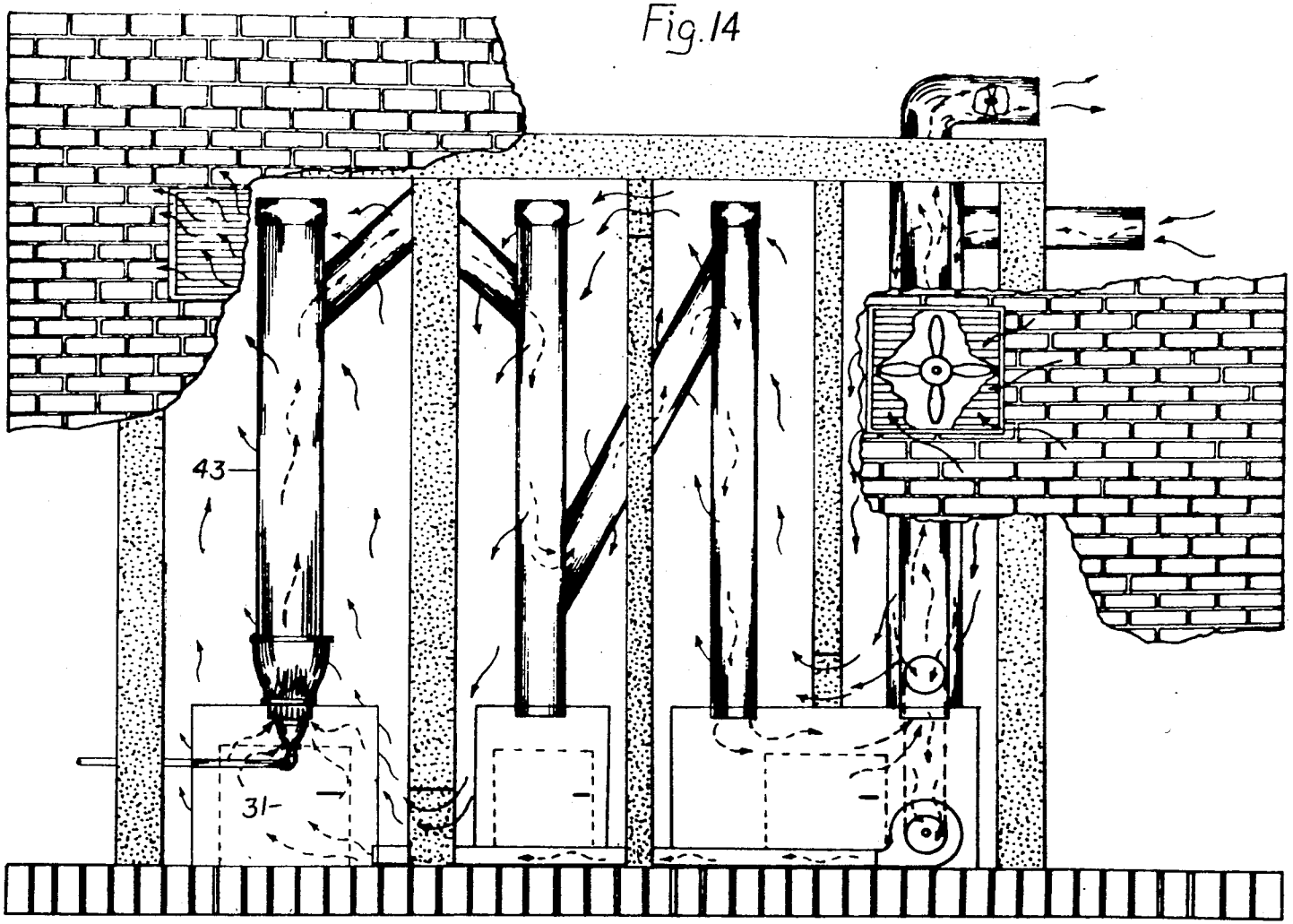
FIG. 14, shows a cut-a-way view of the apparatus and its vertical exhaust air pipes and their compartments connecting a gas burner, located in an air tight box with forced draft, to the outdoor air.

FIG. 14, illustrates a cut-a-way view of the apparatus with the lower end of vertical exhaust air pipe 43 inserted into the air tight box 31, which contains a gas burner, thus the apparatus connects the exhaust from the gas burner to the outdoor air, and extracts the heat thereof.

Figure 15:
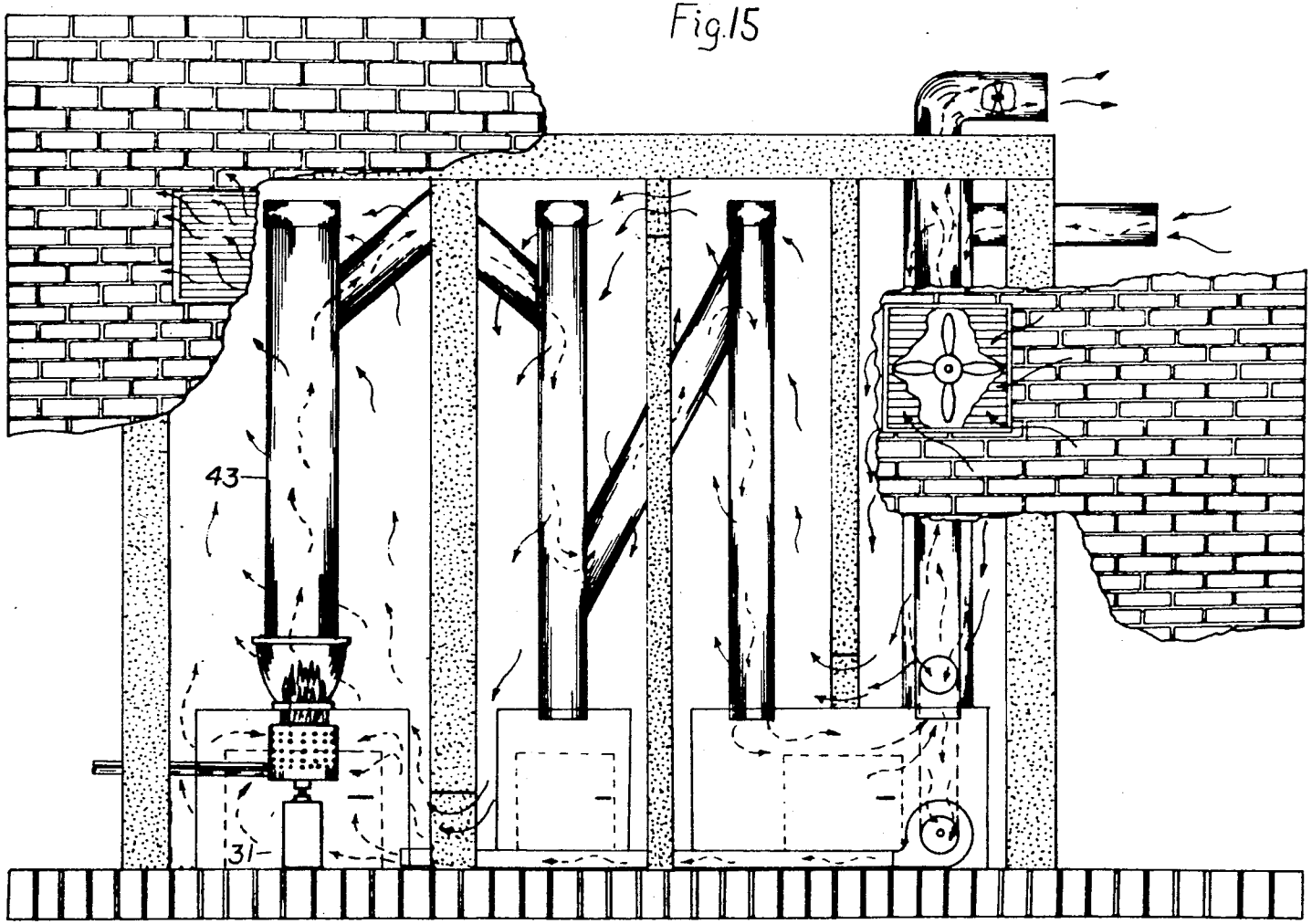
FIG. 15, is a cut-a-way top view of the apparatus and its vertical exhaust air pipes and their compartments connecting an oil burner, located in an air tight box with forced draft, to the outdoor air.

FIG. 15, illustrates the apparatus with the lower end of vertical exhaust air pipe 43 inserted into the air tight box 31, which contains an oil burner, thus the apparatus connects the exhaust from the oil burner to the outdoor air and extracts the heat thereof.

Figure 18:
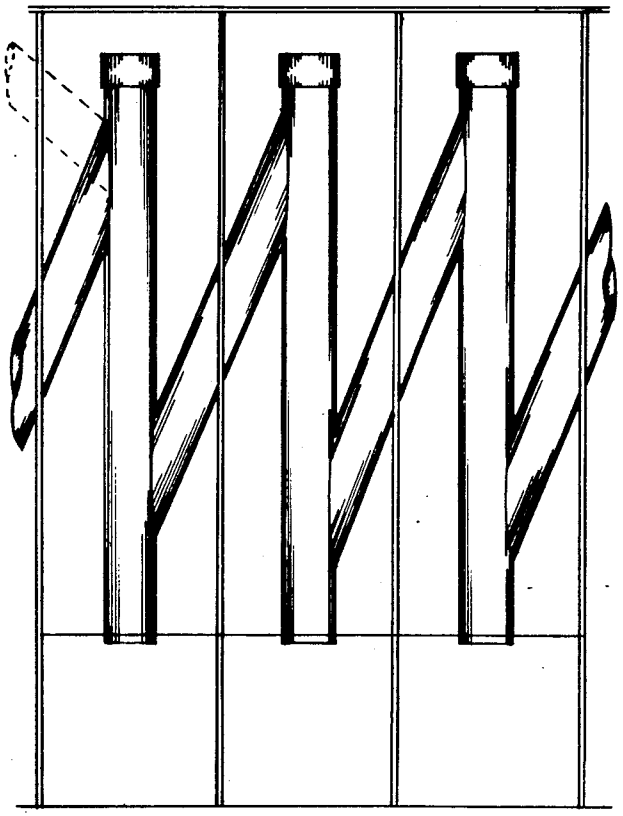
FIGS. 16, 17, and 18, are views of how vertical exhaust air pipe compartments can be added to extend the flue to desired lengths to capture all the heat from a fuel burn exhaust.
Figure 17:
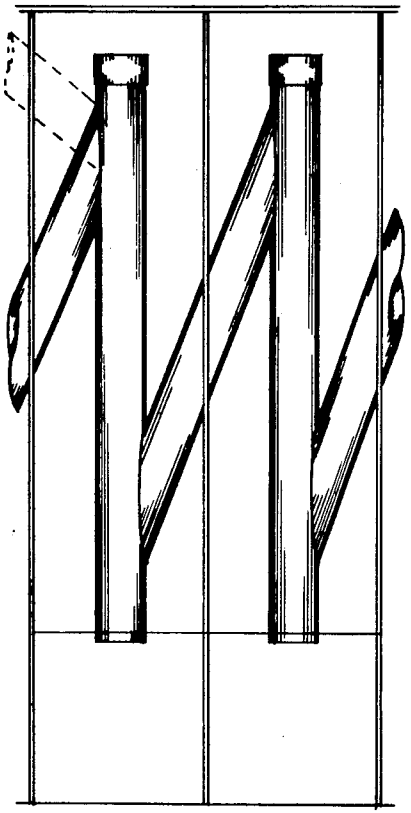
Figure 16:
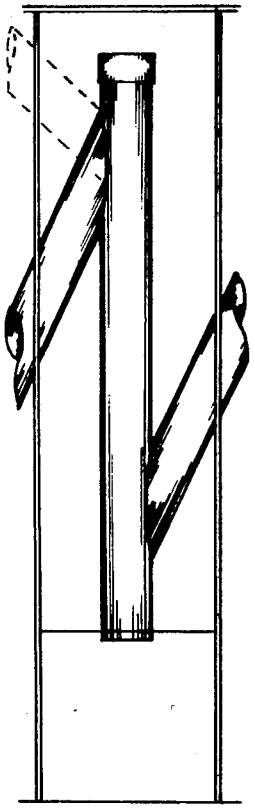

FIGS. 16, 17, and 18, illustrate how vertical exhaust air pipes and their compartments can be added to the apparatus, thus adjusting it to any desired length necessary to extract all the heat from the fuel burn exhaust of a furnace, stove or fireplace.

It is to be understood that the foregoing drawings and description of the invention is to be taken as a preferred embodiment and that various other modifications will occur to those skilled in the art upon reading the disclosure, however all changes and modifications that come within the spirit of the invention are desired to be protected.

I claim:

1. A method of conveying the fuel burn exhaust gases from a furnace, stove or fireplace to the outdoors and extracting heat, soot and fly ash from said exhaust, and delivering said heat indoors, comprising the steps of a. providing a vertically positioned exhaust air pipe, with capped upper end, having its lower end attached to the exhaust of a furnace, stove or fireplace, or having its side attached to said exhaust with its lower end inserted into the top of an air tight box, having a servicing door, b. providing a least two vertically positioned exhaust air pipes, with capped upper ends, and with each having its lower end inserted into the top of an air tight box, having a servicing door, located parallel to the vertically positioned exhaust air pipe that is attached to the exhaust of the furnace, stove or fireplace, said vertically positioned exhaust air pipes all connected in series by connecting pipe sections, which are semi-vertical, c. having means for connecting the vertically positioned exhaust air pipe most remote from the firebox area, or its air tight box, to the outdoor air, with said means containing an induced draft fan, d. providing a forced draft fan with means for drawing outdoor intake air through the means that conveys fuel burn exhaust to the outdoor air, for heat extraction, and with means for delivering said heated intake air to the firebox area, e. surrounding each vertical exhaust air pipe with a layer of insulated partitions, thus creating enclosed vertical exhaust air pipe compartments, f. having at least one of the vertical exhaust air pipe compartments containing a volume of gravel, or small rocks, which covers its vertical and semi-vertical exhaust air pipes, said gravel being supported by a horizontal frame covered with hardware cloth, near its base and serving as a storage for the heat from the vertical and semi-vertical exhaust air pipes, g. locating an indoor air circulating fan with means for circulating indoor air into the vertical exhaust air pipe compartment most remote from the firebox area and means for said air circulating through each adjacent compartment and any gravels in series the height of that compartment, and means for circulating back indoors from the top of the compartment containing the firebox area, thus transferring heat from the vertical and semi-vertical exhaust air pipes and any gravels to the indoors, h. installing an insulated cover over the apparatus with appropriate servicing doors and utility connection means.

2. A method of conveying the fuel burn exhaust gases from a furnace, stove or fireplace, to the outdoors and extracting heat, soot and fly ash from said exhaust and delivering said heat indoors, and into a water storage tank, comprising the steps of a. providing a vertically positioned exhaust air pipe, with capped upper end, having its lower end attached to the exhaust of a furnace, stove or fireplace, or having its side attached to said exhaust with its lower end inserted into the top of an air tight box, having a servicing door, b. providing at least two vertically positioned exhaust air pipes, with capped upper ends, and with each having its lower end inserted into the top of an air tight box, having a servicing door, located parallel to the vertically positioned exhaust air pipe that is attached to the exhaust of the furnace, stove or fireplace, said vertically positioned exhaust air pipes all connected in series by connecting pipe sections, which are semi-vertical, c. having means for connecting the vertically positioned exhaust air pipe most remote from the firebox area, or its air tight box, to the outdoor air, with said means containing an induced draft fan, d. providing a forced draft fan with means for drawing outdoor intake air through the means that conveys fuel burn exhaust to the outdoor air, for heat extraction, and with means for delivering said heated intake air to the firebox area, e. surrounding each vertical exhaust air pipe with a layer of insulated partitions, thus creating enclosed vertical exhaust air pipe compartments, f. positioning water heat pipes against at least one of the vertical exhaust air pipes with means of circulating water from a storage tank through said water heat pipes and back into the storage tank, thus delivering heat from the vertical and semi-vertical exhaust air pipes into the storage water tank, said water heat pipes being covered with a volume of gravel, contained by the vertical exhaust air pipe compartment, or compartments, g. having at least two of the vertical exhaust air pipe compartments containing a volume of gravel, or small rocks, which covers their vertical and semi-vertical exhaust air pipes, said gravel being supported by a horizontal frame covered with hardware cloth, near the base of each compartment, and serving as a storage for heat from the vertical and semi-vertical exhaust air pipes, h. locating an indoor air circulating fan with means for circulating indoor air into the vertical exhaust air pipe compartment most remote from the firebox area and means for said air circulating through each adjacent compartment and any gravels in series the height of that compartment, and means for circulating back indoors from the top of the compartment containing the firebox area, thus transferring heat from the vertical and semi-vertical exhaust air pipes and any gravels to the indoors, i. installing an insulated cover over the apparatus with appropriate servicing doors and utility connection means.

3. A method of conveying the fuel burn exhaust gases from a furnace, stove, fireplace or firebox to the outdoors and extracting heat, soot and fly ash from said exhaust, and delivering said heat into water storage tanks, comprising the steps of a. providing a vertically positioned exhaust air pipe, with capped upper end, having its lower end attached to the exhaust of a furnace, stove, fireplace or firebox, or having its side attached to said exhaust with its lower end inserted into the top of an air tight box, having a servicing door, b. providing at least two vertically exhaust air pipes, with capped upper ends, and with each having its lower end inserted into the top of an air tight box, having a servicing door, located parallel to the vertically positioned exhaust air pipe that is attached to the exhaust of the furnace, stove, fireplace or firebox, said vertically positioned exhaust air pipes all connected in series by connecting pipe sections, which are semi-vertical, c. having means for connecting the vertically positioned exhaust air pipe most remote from the firebox area, or its air tight box, to the outdoor air, with said means containing an induced draft fan, d. providing a forced draft fan with means for drawing outdoor intake air through the means that conveys fuel burn exhaust to the outdoor air, for heat extraction, and with means for delivering said heated intake air to the firebox area, e. surrounding each vertical exhaust air pipe with a layer of insulated partitions, thus creating enclosed vertical exhaust air pipe compartments, f. positioning water heat pipes against at least one of the vertical exhaust air pipes with means of circulating water from a storage tank through said water heat pipes and back into the storage tank, thus delivering heat from the vertical and semi-vertical exhaust air pipes into the water storage tank, g. covering said water heat pipes with a volume of gravel, contained by the vertical exhaust air pipe compartment or compartments, h. installing an insulated cover over the apparatus with appropriate servicing doors and utility connection means.

4. A method of conveying the fuel burn exhaust gases from a furnace, stove, fireplace or firebox to the outdoors and extracting heat, soot and fly ash from said exhaust, and delivering said heat indoors, comprising the steps of a. providing a vertically positioned exhaust air pipe, with capped upper end, having its lower end attached to the exhaust of a furnace, stove, fireplace or firebox, or having its side attached to said exhaust with its lower end inserted into the top of an air tight box, having a servicing door, b. providing at least two vertically positioned exhaust air pipes, with capped upper ends, and with each having its lower end inserted into the top of an air tight box, having a servicing door, located parallel to the vertically positioned exhaust air pipe that is attached to the exhaust of the furnace, stove, fireplace or firebox, said vertically positioned exhaust air pipes all connected in series by connecting pipe sections, which are semi-vertical, c. having means for connecting the vertically positioned exhaust air pipe most remote from the firebox area, or its air tight box, to the outdoor air, with said means containing an induced draft fan, d. providing a forced draft fan with means for drawing outdoor intake air through the means that conveys fuel burn exhaust to the outdoor air, for heat extraction, and with means for delivering said heated intake air to the firebox area, e. surrounding each vertical exhaust air pipe with a layer of insulated partitions, thus creating enclosed vertical exhaust air pipe compartments, f. locating an indoor air circulating fan with means for circulating indoor air into the vertical exhaust air pipe compartment most remote from the firebox area and means for said air circulating through each adjacent compartment in series the height of that compartment, and means for circulating back indoors from the top of the compartment containing the firebox area, thus transferring heat from the vertical and semi-vertical exhaust air pipes to the indoors, g. installing an insulated cover over the apparatus with appropriate servicing doors and utility connection means.

5. A method of conveying the fuel burn exhaust gases from a furnace, stove, fireplace, or firebox to the outdoors and extracting heat, soot, and fly ash from said exhaust, comprising the steps of a. providing a vertically positioned exhaust air pipe, with capped upper end, having its lower end attached to the exhaust of a furnace, stove, fireplace, or firebox, or having its side attached to said exhaust with its lower end inserted into the top of an air tight box, having a servicing door, b. providing at least two vertically positioned exhaust air pipes, with capped upper ends, and with each having its lower end inserted into the top of an air tight box, having a servicing door, located parallel to the vertically positioned exhaust air pipe that is attached to the exhaust of the furnace, stove, fireplace, or firebox, said vertically positioned exhaust air pipes all connected in series by connecting pipe sections, which are semi-vertical, c. having means for connecting the vertically positioned exhaust air pipe most remote from the firebox area, or its air tight box, to the outdoor air, with said means containing an induced draft fan, d. providing a forced draft fan with means for drawing outdoor intake air through the means that conveys fuel burn exhaust to the outdoor air, for heat extraction, and with means for delivering said heated intake air to the firebox area.

6. A method of conveying the fuel burn exhaust gases from a forced draft furnace, stove, fireplace or firebox to the outdoors and extracting heat, soot and fly ash from said exhaust, comprising the steps of a. providing a vertically positioned exhaust air pipe, with capped upper end, having its lower end atached to the exhaust of a furnace, stove, fireplace of firebox, or having its side attached to said exhaust, with its lower end inserted into the top of an air tight box, having a servicing door, b. providing at least two vertically positioned exhaust air pipes, with capped upper ends, and with each having its lower end inserted into the top of an air tight box, having a servicing door, located parallel to the vertically positioned exhaust air pipe that is attached to the exhaust of the furnace, stove, fireplace, or firebox, said vertically positioned exhaust air pipes all connected in series by connecting pipe sections, which are semi-vertical, c. having means for connecting the vertically positioned exhaust air pipe most remote from the firebox area, or its air tight box, to the outdoor air.

* * * * *